US007472956B2

(12) United States Patent
Makhsous et al.

(10) Patent No.: US 7,472,956 B2
(45) Date of Patent: Jan. 6, 2009

(54) PNEUMATIC SUPPORT SYSTEM FOR A WHEELCHAIR

(75) Inventors: Mohsen Makhsous, Chicago, IL (US); Fang Lin, Chicago, IL (US); Susan J. Taylor, Vernon Hills, IL (US)

(73) Assignee: Rehabilitation Institute of Chicago, Chicago, IL (US)

( * ) Notice: Subject to any disclaimer, the term of this patent is extended or adjusted under 35 U.S.C. 154(b) by 0 days.

(21) Appl. No.: 11/363,350

(22) Filed: Feb. 27, 2006

(65) Prior Publication Data

US 2006/0192362 A1 Aug. 31, 2006

Related U.S. Application Data

(60) Provisional application No. 60/657,328, filed on Feb. 28, 2005.

(51) Int. Cl.
*A47C 7/46* (2006.01)

(52) U.S. Cl. ..... 297/284.9; 297/464

(58) Field of Classification Search ..... 297/284.1, 297/284.6, 284.9, 464
See application file for complete search history.

(56) References Cited

U.S. PATENT DOCUMENTS

| | | | | |
|---|---|---|---|---|
| 3,640,571 A | | 2/1972 | Keropian | |
| 4,623,194 A | | 11/1986 | Pillot | |
| 4,647,066 A | * | 3/1987 | Walton | 297/284.1 |
| 4,655,505 A | * | 4/1987 | Kashiwamura et al. | 297/284.6 |
| 4,707,027 A | * | 11/1987 | Horvath et al. | 297/284.6 |
| 5,005,904 A | * | 4/1991 | Clemens et al. | 297/284.6 |
| 5,149,173 A | | 9/1992 | Jay et al. | |
| 5,152,579 A | * | 10/1992 | Bishai | 297/284.6 |
| 5,211,446 A | | 5/1993 | Jay et al. | |
| 5,366,277 A | * | 11/1994 | Tremblay | 297/464 |
| 5,487,197 A | | 1/1996 | Iskra, Jr. et al. | |
| 5,967,613 A | | 10/1999 | McKeever | |

(Continued)

FOREIGN PATENT DOCUMENTS

| | | |
|---|---|---|
| EP | 0 698 361 A2 | 2/1996 |

(Continued)

*Primary Examiner*—Peter R. Brown
(74) *Attorney, Agent, or Firm*—Drinker Biddle & Reath LLP

(57) ABSTRACT

A pneumatic support system for a wheelchair is provided herein. An implementation includes a support unit that supports a portion of the body of a user, a control unit that permits the user to control whether the support unit gets inflated or deflated, and a compressor that provides pressurized air to the support unit to inflate the support unit. The wheelchair has a valve, such when the user indicates that the support unit is to be inflated, the control unit sends a signal to the valve to move the valve to a first position, thereby permitted the pressurized air to reach the support unit. The support unit may be implemented in a variety of ways, and may be one of many support units. In one implementation, the support unit supports a thoracic portion of the user's body. In another implementation, the wheelchair has one or more thoracic support units, which may be disposed on opposite sides of the thoracic portion of the user's body, and one or more pelvic support units, which may be disposed on opposite sides of the user's pelvis. The thoracic support units and or the pelvic support units may be pivotally attached to the back support of the wheelchair.

25 Claims, 8 Drawing Sheets

U.S. PATENT DOCUMENTS

| | | | | |
|---|---|---|---|---|
| 6,098,000 | A * | 8/2000 | Long et al. | 297/284.6 |
| 6,186,594 | B1 | 2/2001 | Valiquette et al. | |
| 6,560,803 | B2 | 5/2003 | Zur | |
| 6,575,492 | B2 | 6/2003 | Davidson | |
| 7,093,898 | B2 * | 8/2006 | Ladron De Guevara | 297/284.6 |
| 7,237,848 | B1 * | 7/2007 | Story et al. | 297/485 |
| 2003/0038517 | A1 * | 2/2003 | Moran et al. | 297/284.3 |
| 2007/0057551 | A1 * | 3/2007 | Lachenmann et al. | 297/284.9 |

FOREIGN PATENT DOCUMENTS

| | | |
|---|---|---|
| WO | WO 01/43685 A1 | 6/2001 |
| WO | WO 02/19872 A1 | 3/2002 |

* cited by examiner

PNEUMATIC SUPPORT SYSTEM FOR A WHEELCHAIR

CROSS-REFERENCE TO RELATED PATENT APPLICATIONS

This patent application claims the benefit of U.S. Provisional Patent Application No. 60/657,328, filed Feb. 28, 2005.

FIELD OF THE INVENTION

This invention pertains to wheelchair user support systems. More particularly, this invention relates to a pneumatic support system for use with a wheelchair.

BACKGROUND OF THE INVENTION

In the U.S. alone, there are approximately 1.4 million individuals who use wheelchairs full time. These individuals have functional impairments for various reasons and are affected at various levels. Depending on the type and level of impairments, the wheelchair seating requirements can be complex. Among those who use wheelchairs regularly, individuals with spinal cord injured (SCI) at the cervical level have altered neuromuscular control, requiring sophisticated seating devices that provide postural stability while permitting functional independence. Independence from the seated position is a primary concern. Additionally, as these individuals use wheelchairs full time, prevention of progressive spinal deterioration and deformity from prolonged sitting is of paramount importance.

Current strategies for wheelchair prescription include devices that provide stability, comfort, and functional independence/mobility, but also that assist in the prevention of the negative biomechanical spinal alterations that occur from prolonged sitting. However, these goals are often in conflict with each other and current devices rarely achieve all of these goals simultaneously. Accordingly, there is a need to successfully maximize all of these factors in one comprehensive seating device.

Pelvic support can be influenced at four regions: inferior, lateral, anterior, and posterior. The base of support (inferior support) for the pelvis is usually provided by the seat cushion. Lateral pelvic support is achieved through separate blocks or wedges that are either a component of the seating system or attached to the wheelchair. Anterior support is currently achieved through hip or lap belts. However, these devices are known to restrict movement of the user and impose high loads on the abdominal cavity. Posterior support is determined by the shape of the back support and the lumbar pad. Because these supportive devices are, in general, rigidly attached to the seating system, and are designed to be adjusted or removed by the caregiver, they tend to restrict the user to a fixed position.

Thoracic level support is generally achieved through lateral thoracic supports. Although these devices are available in various sizes and materials, they are typically mounted to the back support or backposts of the wheelchair, further restricting the user to a fixed position. To be effective, these devices must make intimate contact with the trunk. However, as trunk mobility is necessary to perform functional activities, these devices often need to be released. Although current lateral thoracic supports have "swing-away" or removable features, adjustment of these supports usually requires the assistance of the caregiver. Furthermore, these rigid, fixed devices may cause respiratory difficulty and soft-tissue irritation.

Thus, current seating designs often result in a compromise between user stability and functional independence. In wheelchair seating assessments and fittings, a compromise is made to find a posture that is the most tolerable and functional for the user—one which allows the user mobility necessary to accomplish activities of daily living (ADL), yet still provides enough stability to accommodate weak or paralyzed muscles. Unfortunately, as a result of the interference of these supportive devices on user function, many wheelchair users opt not to use these supportive devices, thereby exposing themselves to the negative effects of unsupported sitting.

Thus, a sacral/pelvic stabilizing device that provides pelvic support while allowing simple user adjustment to allow movement, independent of a caregiver, and prevents pressure overload of the abdomen would be a significant improvement. Similarly, a thoracic support device which provides thoracic support while allowing simple user adjustment to allow movement, independent of a caregiver, and which does not cause respiratory difficulty or soft-tissue irritation also would be a significant improvement.

As stated previously, SCI individuals who use wheelchairs full time, are susceptible to the negative consequences of prolonged sitting, which not only includes PU formation, but spinal degeneration from prolonged spinal loading. Additionally, studies demonstrate that wheelchair users are exposed to unacceptable levels of whole body vibration (WBV) when propelling over uneven surfaces. As current seating systems do not permit movement of the back support relative to the seat cushion as the wheelchair propels over uneven or rugged terrain, the user's body is subject to elevated levels of WBV. Thus, it can be seen that improved design of the seat and back support may reduce WBV.

SUMMARY

In accordance with the foregoing, a wheelchair with a pneumatic support system is provided. In one embodiment, the wheelchair includes a support unit that supports a portion of the body of a user, a control unit that permits the user to control whether the support unit gets inflated or deflated, and a compressor that provides pressurized air to the support unit to inflate the support unit. In a more specific embodiment, the wheelchair has a valve, wherein when the user indicates that the support unit is to be inflated, the control unit sends a signal to the valve to move the valve to a first position, thereby permitted the pressurized air to reach the support unit. The support unit may be implemented in a variety of ways, and may be one of many support units. In one embodiment, the support unit supports a thoracic portion of the user's body. In another embodiment, the wheelchair has one or more thoracic support units, which may be disposed on opposite sides of the thoracic portion of the user's body, and one or more pelvic support units, which may be disposed on opposite sides of the user's pelvis. The thoracic support units and or the pelvic support units may be pivotally attached to the back support of the wheelchair.

In one embodiment, the control unit has a first control that permits the user to inflate and deflate the thoracic supports and a second control that permits the user to inflate and deflate the pelvic supports. In another embodiment, the support unit is one of a group of support units, the group being one of a plurality of groups of support units on the wheelchair, each of the groups being pneumatically linked to the compressor, wherein the control unit comprises a control associated with each of the plurality of groups of support units, wherein the control sends a signal to permit inflation or deflation of the group of support units with which the control is associated. In yet another embodiment, the wheelchair includes a pressure sensor disposed on the support unit, the pressure sensor transmitting pressure data, wherein when the data indicates that the pressure of the support unit has exceeded a predetermined limit, the compressor stops inflating the support unit.

A support system for a wheelchair is also described herein. According to an embodiment of the invention, the support system includes a first support and a second support disposed on opposing sides of a user of the wheelchair. Each of the supports has an air bladder, and each provides support to the user. The system further includes a pneumonic pathway, an air compressor connected to the air bladder via the pneumonic pathway, a valve disposed along the pneumonic pathway, the valve having at least a first position, in which it permits pressurized air to travel from the compressor to the air bladder, and a second position in which it permits air to escape from the air bladder. The system further includes a control unit that, in response to first input by the user, sends a first signal to the valve to move it to the first position to inflate the bladder and, in response to a second input by the user, sends a second signal to the valve to move it to the second position to deflate the bladder.

In one embodiment of the invention, the bladder is one of a plurality of bladders, the valve is one of a plurality of valves, and each valve of the plurality is associated with a bladder of the plurality of bladders. In this embodiment, the control unit includes a plurality of controls, each of which is associated with a bladder of the plurality of bladders. Each control is configured to send a signal to the valve that serves with the bladder with which the control is associated.

In another embodiment of the invention, the control unit includes a logic circuit and a means for receiving the first and second inputs (such as a button or a switch). The logic circuit is configured such that when a user makes the first input to the receiving means, the logic circuit generates an inflation signal, and when the user makes the second input to the receiving means, the logic circuit generates a deflation signal. The logic circuit may include a counter that receives signals representing the first and second inputs, a pair of AND gates that receive outputs from the counter, and a pair of relays that receive outputs from the counter and generate either the inflation or deflation signals in response thereto.

In yet another embodiment of the invention, support system includes an inflation lamp that illuminates when the inflation signal is generated and a deflation lamp that illuminates when the deflation signal is generated.

A method for supporting a wheelchair user is also described herein. According to an embodiment of the invention, the method involves receiving an input from the user, the input corresponding to a support unit on a wheelchair, and, based on the input, transmitting a signal to a valve to place the valve into a first position. The method also involves sending compressed air through a pneumonic pathway from a compressor to the support unit via the valve and inflating the support unit to provide support to a portion of the user's body.

In an embodiment of the invention, the input is a first input, the signal is a first signal, and the method further includes the steps of receiving a second input from the user; based on the second input, transmitting a second signal to the valve to place the valve into a second position; and permitting air to escape from the support through the valve via the pneumonic pathway.

In a further embodiment, the valve is a first valve, and the method further includes the steps of receiving a second input from the user, and, based on the second input, transmitting a second signal to a second valve to place the second valve into a first position, sending compressed air through a pneumonic pathway from a compressor to the second support unit via the second valve. In this embodiment, the method also includes inflating the second support unit to provide support to a second portion of the user's body. In other embodiments, the method includes illuminating an inflation lamp to indicate to the user that the support unit is being inflated. In still other embodiments, the method includes detecting that the pressure in the support unit has exceeded a predetermined amount and, in response thereto, moving the valve into another position so as to permit air to escape from the support unit.

DETAILED DESCRIPTION OF THE INVENTION

Figure 1:
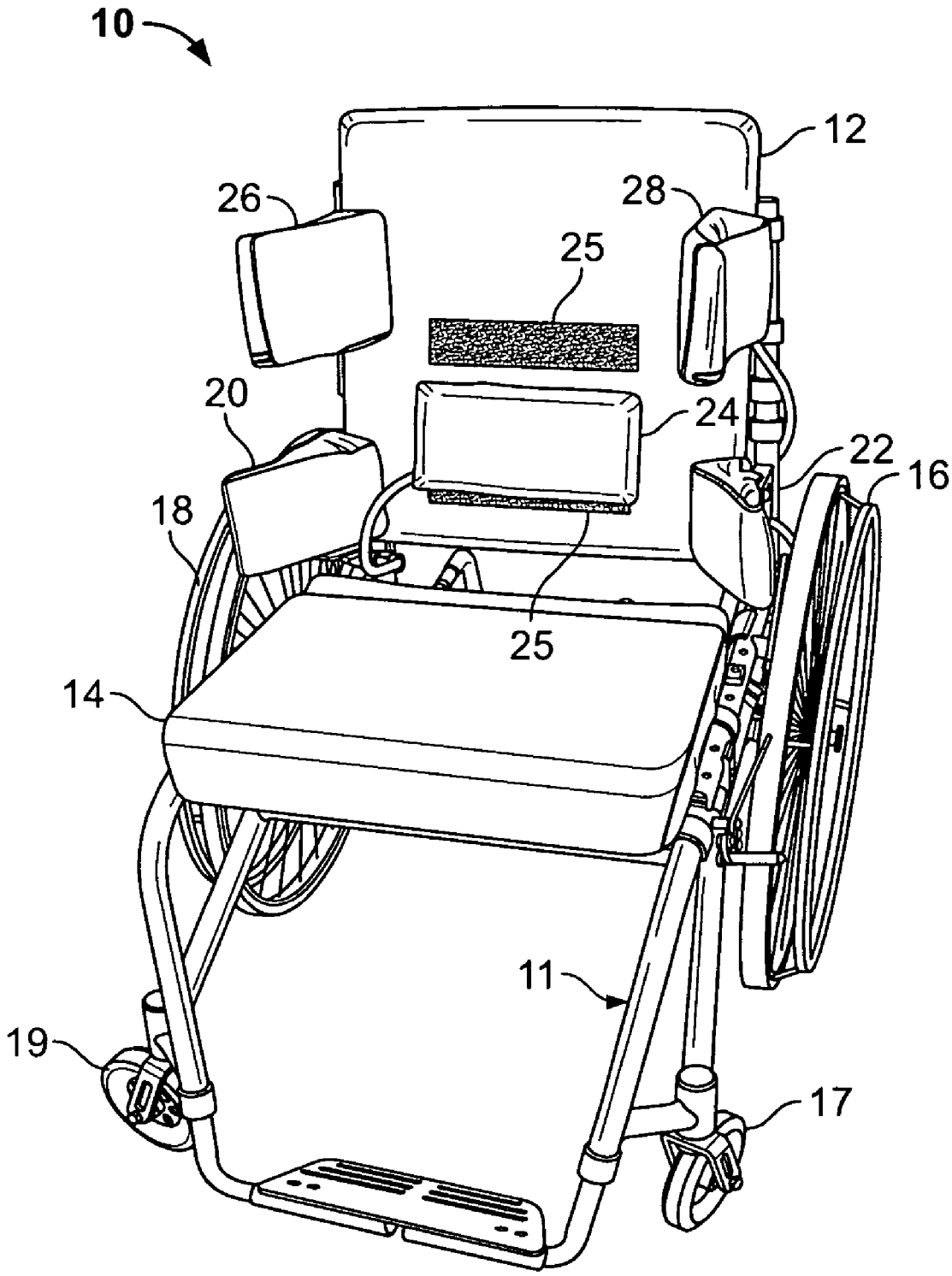
FIG. 1 is a wheelchair configured according to an embodiment of the invention.

The invention is generally directed to a wheelchair with a pneumatic support system. In various embodiments of the invention, the system is a comprehensive supporting system for wheelchair seating. Significantly, users of the system are able to both achieve postural stability and maintain functional independence. An embodiment of the invention includes bilateral postero-lateral pelvic support units, a lumbo-sacral support unit, and bilateral lateral thoracic support units. The postero-lateral pelvic support units establish a stable, midline orientation of the pelvis, maximizing upper extremity function. The lumbo-sacral support unit allows correction of pelvic tilt in the anterior/posterior plane. The lateral thoracic support units provide maximal trunk stability without compromising upper extremity functional tasks. Unlike conventional support systems, the support system described herein is user-adjustable through a simple control device, which not only allows individual customization based on user needs, but maximizes independence for mobility and transfers.

An embodiment of the invention includes a suspension system designed to minimize WBV, thereby preventing early degeneration of the spine.

According to an embodiment of the invention, the user can adjust the support units by inflating/deflating air bladders within the support units. The air bladders are contained within pre-contoured cases. To permit easy adjustment of the air bladder supports in an embodiment of the invention, an electro-pneumatic control device, which includes both pneumatic and electronic sub-systems, is provided. The pneumatic subsystem includes an air compressor to enable the inflation/deflation of the air bladders and an air valve system to direct the air flow. The pneumatic subsystem allows adjustment of each support unit. It is controlled by the user through the electronic subsystem to choose to inflate/deflate both lateral pelvic pads simultaneously, both lateral thoracic pads simultaneously and/or lumbar support by itself. The electronic subsystem includes a pressure sensor, contact sensors, control logic circuit, and an alarming device.

According to an embodiment of the invention, the air flow to and from the air bladder is guided using a two-way solenoid electromechanical valve, which is actuated by a 12 V electrical signal. Three such valves are used for the pelvic supports (both sides simultaneously), lumbo-sacral support, and the lateral thoracic supports (both sides simultaneously). While all 3 valves are connected to the same air compressor, each of them is controlled individually from the electronic subsystem by a signal corresponding to each individual valve. Depending on the signal it receives from the electronic subsystem, a valve will unblock one of two paths so as to (a) allow air to flow from the pump to the bladder, or (b) allow air to flow from the bladder to the pump. The valve may also block the flow of air through both paths entirely. For safety concerns, a manual valve may be mounted parallel to the two-way valve, which allows immediate bladder deflation when necessary. As the user controls the inflation/deflation of the bladders through switches or buttons, various degrees of lateral pelvic, lumbar and lateral thoracic support can be achieved.

In an embodiment of the invention, a single-pole-double-throw (SPDT) electronic switch is used to control each two-way valve. Each of the two throw positions of the switch causes the two-way valve to permit air to flow in one of two directions, thereby adjusting the air pressure of the associated support unit (or units) by inflation/deflation, while the neutral position of the switch will stop the air flow through the valve to maintain the desired air pressure. In another embodiment of the invention, a logic circuit with relays will be used in lieu of a SPDT switch. Such a logic circuit can be controlled by a user with a single button. This single-button operation is particularly advantageous for individuals with motor function impairment, as an SPDT switch may be difficult to activate/deactivate for these individuals, and may be susceptible to inadvertent activation.

In a related embodiment of the invention, the pressure of the air bladders is controlled with a single button for each support unit. Thus, there are three buttons in total—one for the thoracic support units, one for the pelvic support units, and one for the lumbo-sacral support unit. While the button for a support unit or pair of support units is initially pressed, the air compressor inflates the bladder. When the button is pressed again, inflation stops, and the pressure of the air bladder is maintained at a steady level. When the button is pressed again, the bladder deflates until the button is pressed again. In one embodiment, the support system has a small control panel with three buttons of half inch diameter each. For easy identification, each button is a different color. Two arrows, one with an UP shape (representing inflation), the other with a DOWN shape (representing deflation), lit by a corresponding LED lamp, serve to inform the user whether pressing the button for a support unit (or pair of support units) will cause inflation or deflation.

In one embodiment, the support system has a pair of LED lamps for each bladder (or pair of bladders). One of these lamps is an inflation lamp, and the other is a deflation lamp. When the bladder (or pair of bladders) is being inflated, the inflation lamp blinks, indicating that inflation is occurring. When inflation is complete, the inflation lamp stays on, indicating that the bladder (or pair of bladders) is inflated. During inflation and when the bladder is inflated, the deflation lamp remains off. When the bladder (or pair of bladders) is being deflated, the inflation lamp turns off, and the deflation lamp blinks to indicate that deflation is occurring. When deflation is complete, the deflation lamp stays on, indicating that the bladder (or pair of bladders) is deflated. During deflation and when the bladder is deflated, the inflation lamp remains off.

Referring to FIG. 1, a wheelchair that incorporates an embodiment of the invention will now be described. The wheelchair, generally labeled 10, includes a frame assembly 11, a backrest 12, a seat 14, a first drive wheel 16, a second drive wheel 18, a first pivoting wheel 17, and a second pivoting wheel 19. The first and second drive wheels 16 and 18 are rotatably coupled to the frame assembly 11, while the first and second pivoting wheels 17 and 19 are pivotally coupled to the frame assembly 11. The backrest 12 and the seat 14 are coupled to the frame assembly 11 and are oriented at an angle with respect to one another. Typically, the angle is about 90 degrees, but may vary.

Referring still to FIG. 1, the components of an embodiment of the support system will now be described in more detail. The back support system includes 5 body supporting units—a first pelvic support unit 20, a second pelvic support unit 22, a lumbo-sacral support unit 24, a first thoracic support unit 26, and a second thoracic support unit 28, which are all coupled to the backrest 12. The first pelvic support 20, second pelvic support 22, first thoracic support 26, second thoracic support 28 are attached to the backrest 12 such that they can pivot inwardly (toward the user) and outwardly (away from the user). Each of the 5 support units includes an inflatable air bladder and a backing board enclosed in a pre-shaped case, which may be made of RUBATEX. The case is formed to a contoured shape that fits the body habitus, while the air bladder fills the space inside the case to provide support. Each of the support units is further enclosed within a soft outer covering. Each support unit is attached to the backrest 12 with interfacing hardware that permits superior/inferior, medial/lateral, and tilting adjustments. The user is able to control all of these bladders with a user-friendly control panel. The bladders of the first and second thoracic supports 26 and 28 not only allow inflation/deflation, but also permit movement to prevent interference during patient transfers. A chest belt that wraps around the first and second thoracic supports 26 and 28 and fastens anteriorly may also be employed. The chest belt may be used as deemed necessary by the user. The chest belt permits user operation without caregiver assistance and allows clients without finger function to operate it.

Referring again to FIG. 1, the lumbo-sacral support unit 24 in an embodiment of the invention will now be described in more detail. The lumbo-sacral support unit 24 is made of a an ABS plastic backing board (about 6 inches by about 12 inches by about ¼ inches) and includes a similar sized air bladder that is oriented towards the user's body. The lumbo-sacral support unit 24 is enclosed in a pre-shaped RUBATEX case. Strips 25 of Velcro are sutured onto the rear side of the case, which can then be used to easily attach and adjust the lumbo-sacral support unit 24 to the proper location on the backrest 12 of the wheelchair 10.

Figure 2:
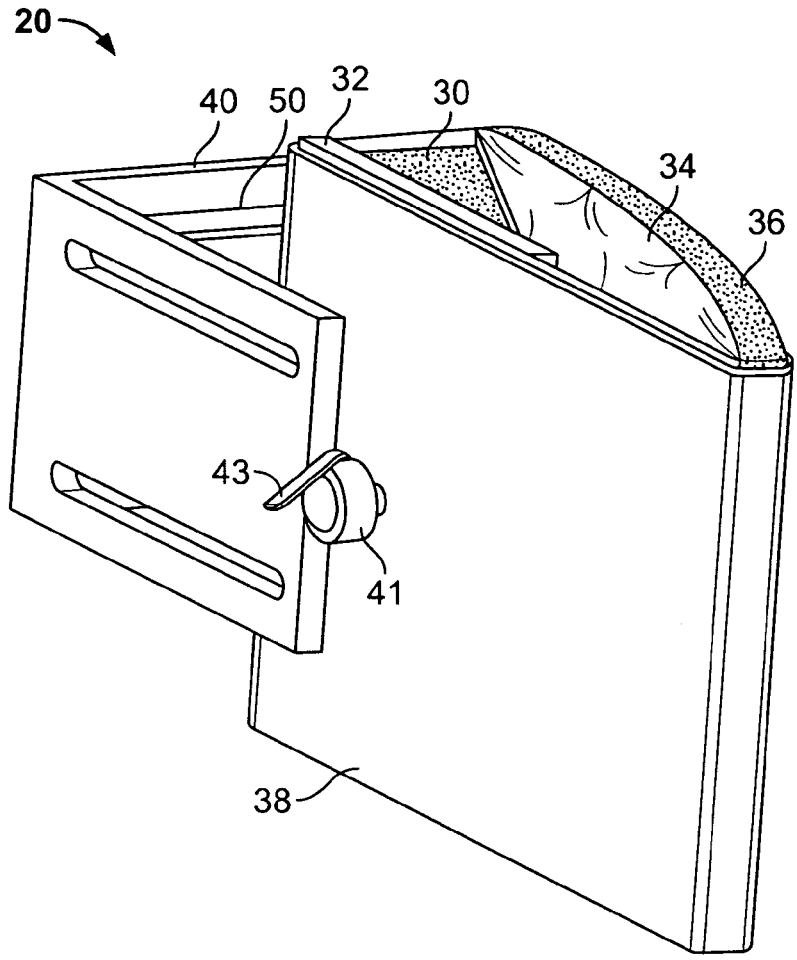
FIG. 2 is a pelvic support unit according to an embodiment of the invention (depicted without its outer covering).
Figure 3:
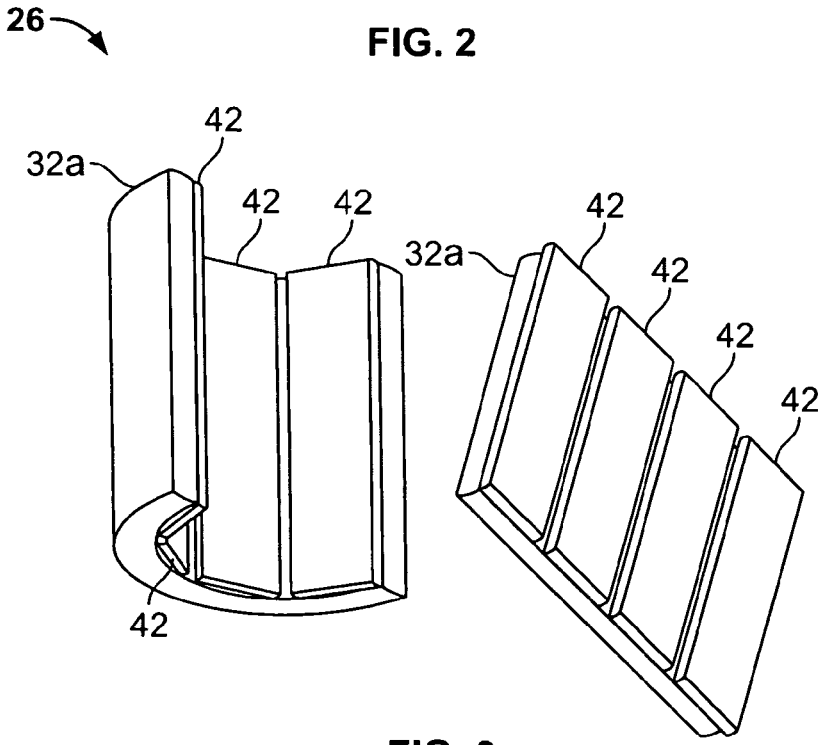
FIG. 3 is a part of a thoracic support unit according to an embodiment of the invention (depicted without its outer covering).

Referring to FIGS. 2 and 3, the configuration of the first and second pelvic support units 20 and 22 according to an embodiment of the invention will now be described in more detail. As shown in FIG. 2, each of the pelvic support units 20 and 22 includes a generally triangularly-shaped foam cushion 30, a backing board 32 in intimate contact with a side of the cushion 30, and a bladder 34 disposed within the cushion 30. In one implementation, the backing board 32 is a hard ABS plastic board with dimensions of about 4 inches by about 4½ inches by about ¼ inches; the cushion 30 is viscoelastic foam; and the bladder 34 is an inflatable air bladder with a deflated dimension of about 4 inches by about 8 inches by about ⅜ inches. In this implementation, the bladder 34 has a dimension larger than the backing board 32 and the cushion 30, thereby providing a soft touch feel for the pelvic support units 20 and 22. Furthermore, the bladder 34 is made of natural rubber.

Referring again to FIG. 2, each of the pelvic supports in an embodiment of the invention further includes a foam layer 36 that covers the bladder 34. In one embodiment, the foam layer 36 is has a thickness of about ¼ inch. The backing board 32, the cushion 30, the bladder 34, and the foam layer 36 are enclosed in a case 38 which, in one embodiment, is RUBATEX. The backing board 32 is articulated onto one end of a generally L-shaped metal piece 40 via a universal joint 41. The universal joint 41 has a locking key 43 that permits the joint 41 to be locked into position. The universal joint 41 provides an adjustable swivel range to accommodate individual user's body habitus and required degree of stability and mobility. In one embodiment, the swivel range of the universal joint 41 is 50°. The locking key 43 of the universal joint 41 maintains the pelvic support units 20 and 22 in an orientation as set by the user or the therapist. The other end of the generally L-shaped piece 40 is then attached to one of the mounting tracks 44 and 46 (see FIG. 4A) via a lockable sliding mechanism.

According to an embodiment of the invention, the first and second thoracic support units 26 and 28 use the same design as that of the pelvic support units 20 and 22, shown in FIG. 2. However, the first and second thoracic support units 26 and 28 do not have the cushion 30, and have a different backing board 32. Referring to FIG. 3, two views of the backing board of the first and second thoracic supports (represented by the first thoracic support unit 26) according to an embodiment of the invention are shown and will now be described. The backing board 32*a* is bendable and, in one embodiment, is viscoelastic foam of about 7 inches by about 5 inches by about ½ inch, with four plastic boards 42, each being about 5 inches by about 1½ inches by about ⅛ inch. The plastic boards 42 are attached and vertically aligned on the back side of the viscoelastic foam. This bendable backing board 32*a* not only provides a strong base for the bladder 34, but also allows the necessary flexibility for transferring the wheelchair user in and out of the wheelchair 10 (FIG. 1).

Figure 4B:
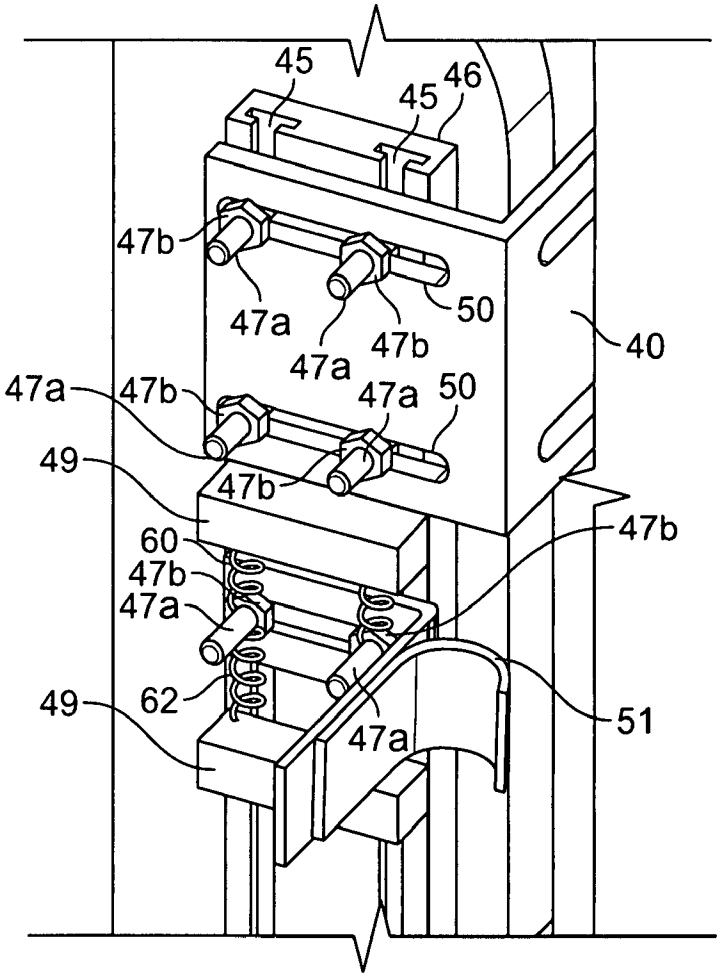
FIGS. 4A, 4B, and 4C show a suspension system according to an embodiment of the invention (all supports are depicted without their outer coverings).
Figure 4A:
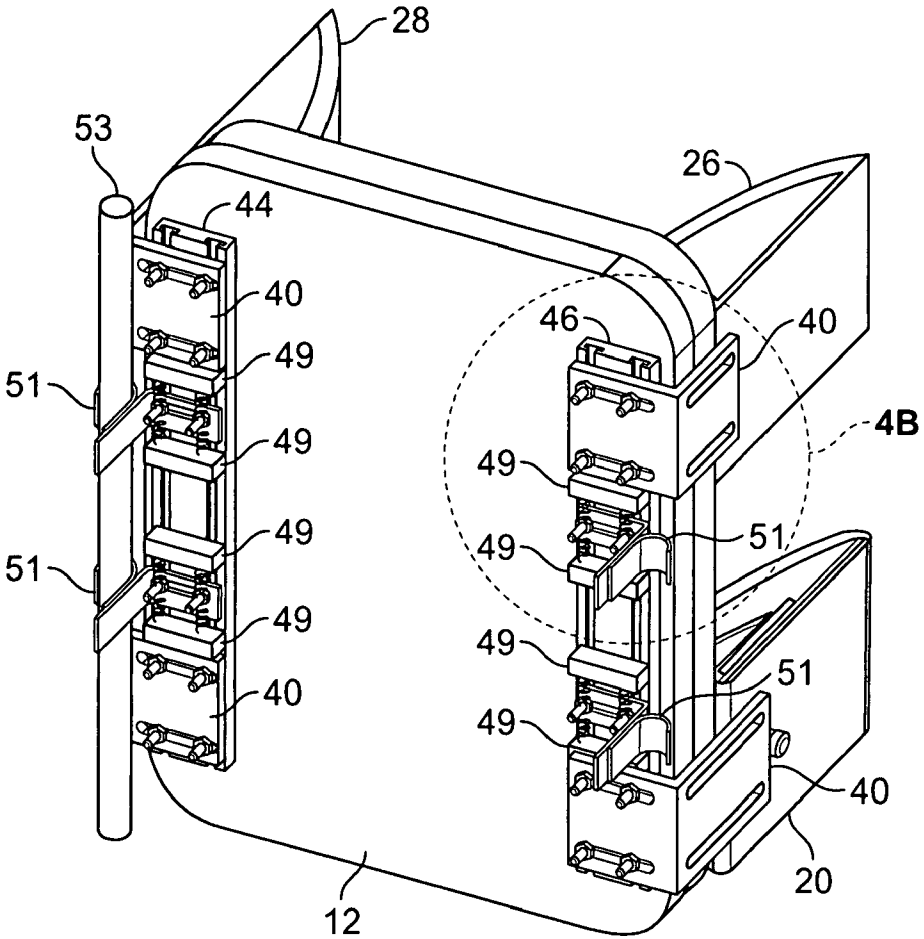
Figure 4C:
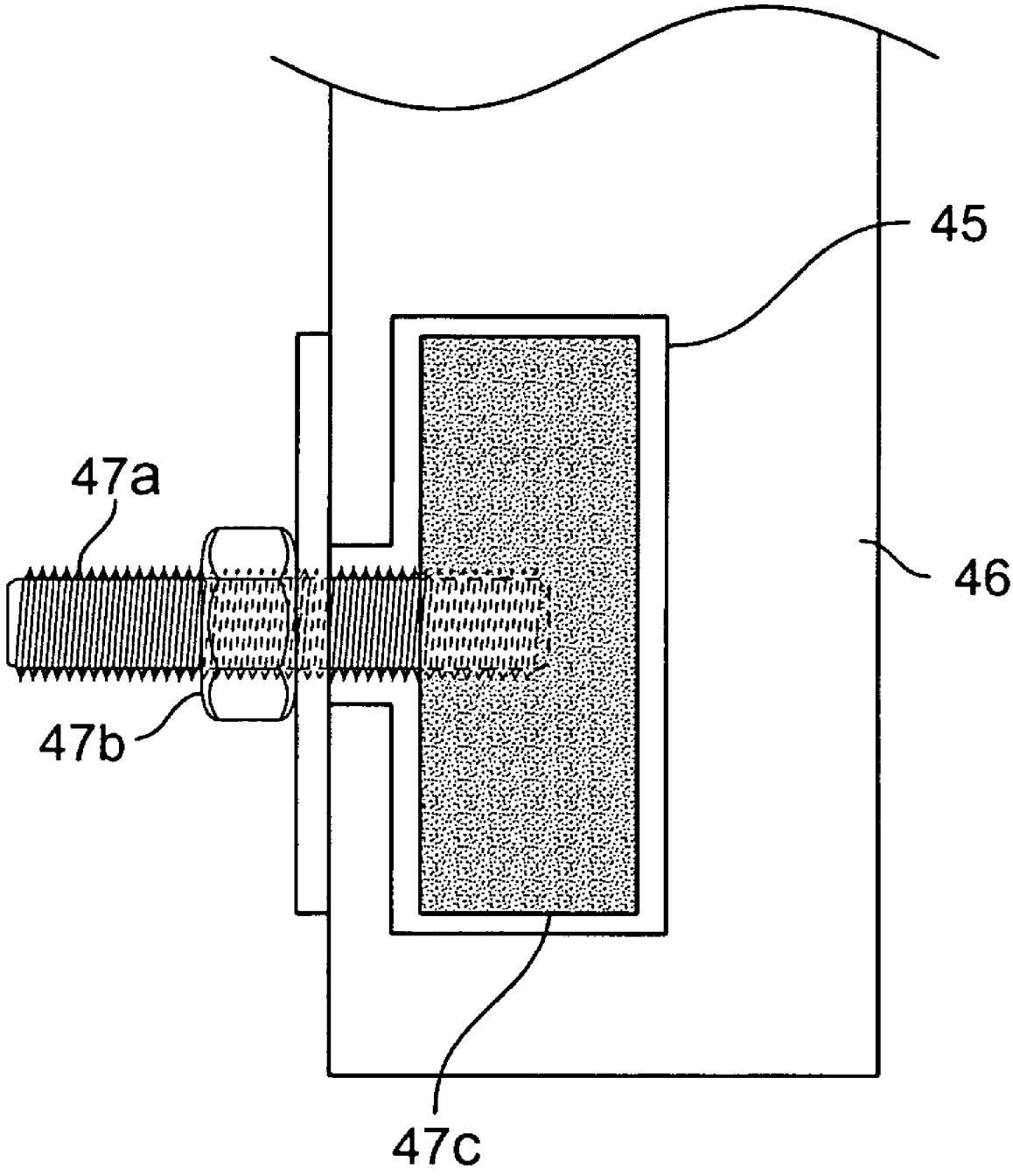

Referring now to FIGS. 4A-4C, the mounting configuration of the support system in an embodiment of the invention will now be described. Two mounting tracks 44 and 46 are attached to the backrest 12 adjacent and roughly parallel to the lateral edges of the backrest 12. The mounting tracks 44 and 46 are about 2 inches by about 16 inches in one implementation, are used as the interfacing hardware to mount the pelvic supports 20 and 22 and the thoracic supports 26 and 28 to the backrest 12 of the wheelchair 10 (FIG. 1). Each of the mounting tracks 44 and 46 has a pair of generally T-shaped channels that run along its length.

Each of the pelvic supports 20 and 22 and the thoracic supports 26 and 28 has a generally L-shaped piece 40 coupled thereto (e.g., as shown in FIG. 2) along one portion of the L-shaped piece 40. The adjacent portion of the L-shaped piece 40 is attached to one of the mounting tracks 44 and 46 as follows. Threaded bolts 47*a* extend through each of two slits 50 of the L-shaped piece (two bolts 47*a* per slit 50). One end of each bolt 47*a* is threadingly engaged with a sliding bar 47*c* (shown in FIG. 4C). The bar 47*c* is disposed within one of the channels 45, and is sized to that it can slide freely along the channel 45. The other end of the bolt 47*c* is threadingly engaged to a nut 47*b*, thereby securing the L-shaped piece (and, hence, the pelvic support or thoracic support) to the mounting track, while permitting the support to slide up or down along the mounting track. Thus, the mounting tracks 44 and 46 provide the ability to adjust the pelvic supports 20 and 22 and the thoracic supports 26 and 28 to the desired height based on individual needs. Furthermore, the nuts 47*b* can be loosened to allow medial-lateral adjustment of the supports along two slits 50 of the generally L-shaped pieces 40 and the re-tightened to fix the support into place.

An optional chest belt made from a 2 inch-wide webbing with Velcro may be attached to the mounting tracks 44 and 46. The chest belt may be used to wrap around the thoracic supports 26 and 28, and can be fastened anteriorly. A thumb loop on the chest belt helps facilitate some users with impaired finger function to grab onto the end. The chest belt helps to secure the user's upper body in the desired posture.

Referring still to FIGS. 4A-4C, installation of the suspension system in an embodiment of the invention will now be described. To install this system in this embodiment, the backrest 12 of the wheelchair 10 is detached from the wheelchair frame assembly 11 (from FIG. 1). As shown in FIG. 4A, the two mounting tracks 44 and 46 are installed vertically onto the rear side of the backrest 12 of the wheelchair 10, adjacent to the lateral edges. Four brackets 51 (two on each side) are used to re-install the backrest 12 on backposts 53 of the frame assembly 11 wheelchair. Since the backposts of various wheelchair models may have different designs, the location of the mounting tracks will preferably be chosen to ensure that the backrest fits into its original wheelchair. Similar to the way the generally L-shaped pieces 40 are attached, the four brackets 51 are mounted on the two mounting tracks 44 and 46 via threaded bolts 47*a*, nuts 47*b*, and sliding bars 47*c*, which slide vertically through along the channels 45. A set of bars 49 are fixed to each of the tracks 44 and 46 to limit the extent to which the brackets 51 are permitted to slide up and down along the channels 45. Two stainless steel compression springs 60 and 62, one on the top, the other at the bottom, connect each of the fixed bars 49 to the bolts 47*a*. In this way, each bracket 51 is able to slide vertically along the track in a range that is constrained by the fixed bars 49, with the springs 60 and 62 acting as shock absorbers. Thus, while mounted on the wheelchair backposts, the whole backrest 12 is suspended by 16 springs.

Figure 5:
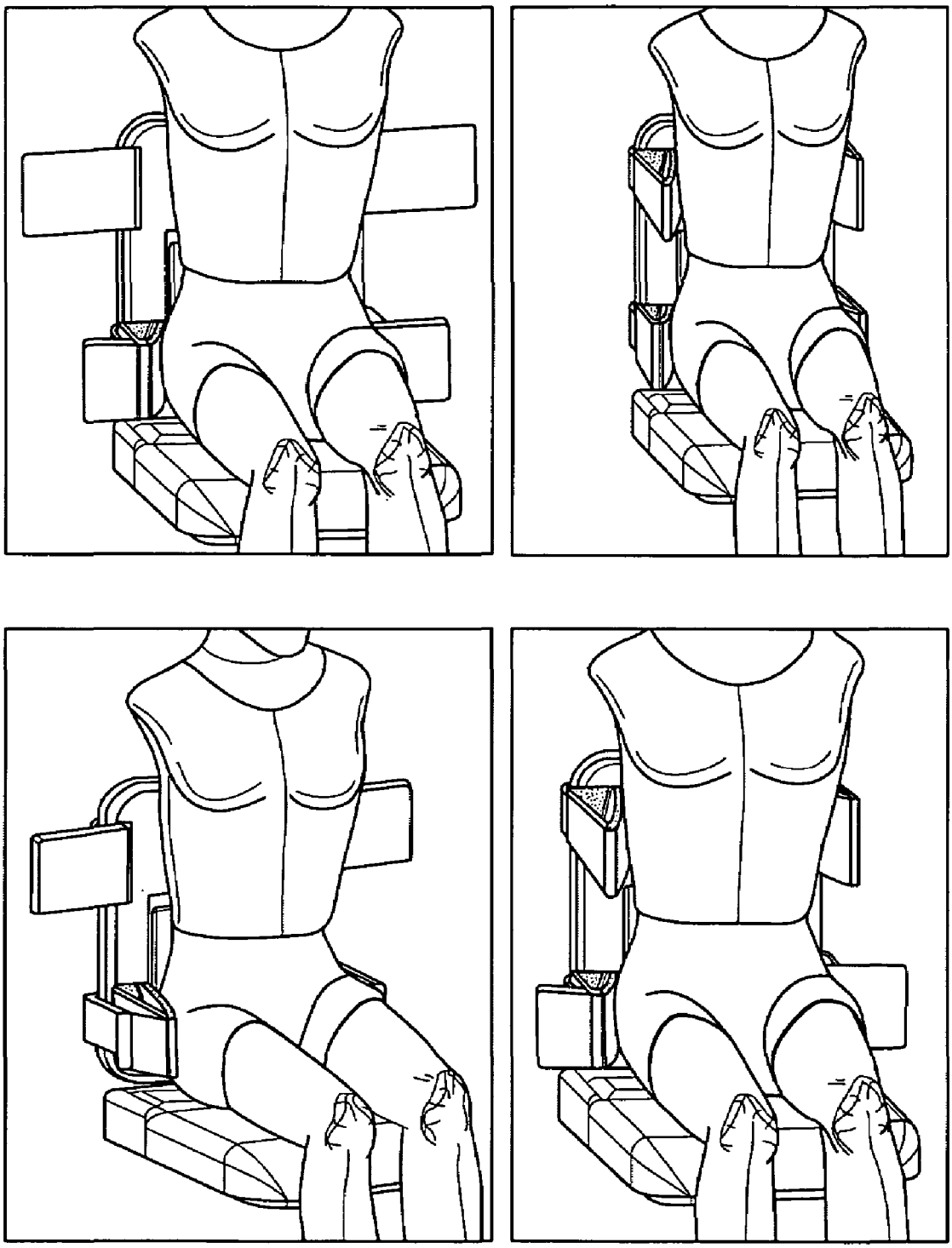
FIGS. 5 & 6 show how the suspension system of FIGS. 4A-4C can be used with different wheelchair configurations (all support units are depicted without their outer coverings).
Figure 6:
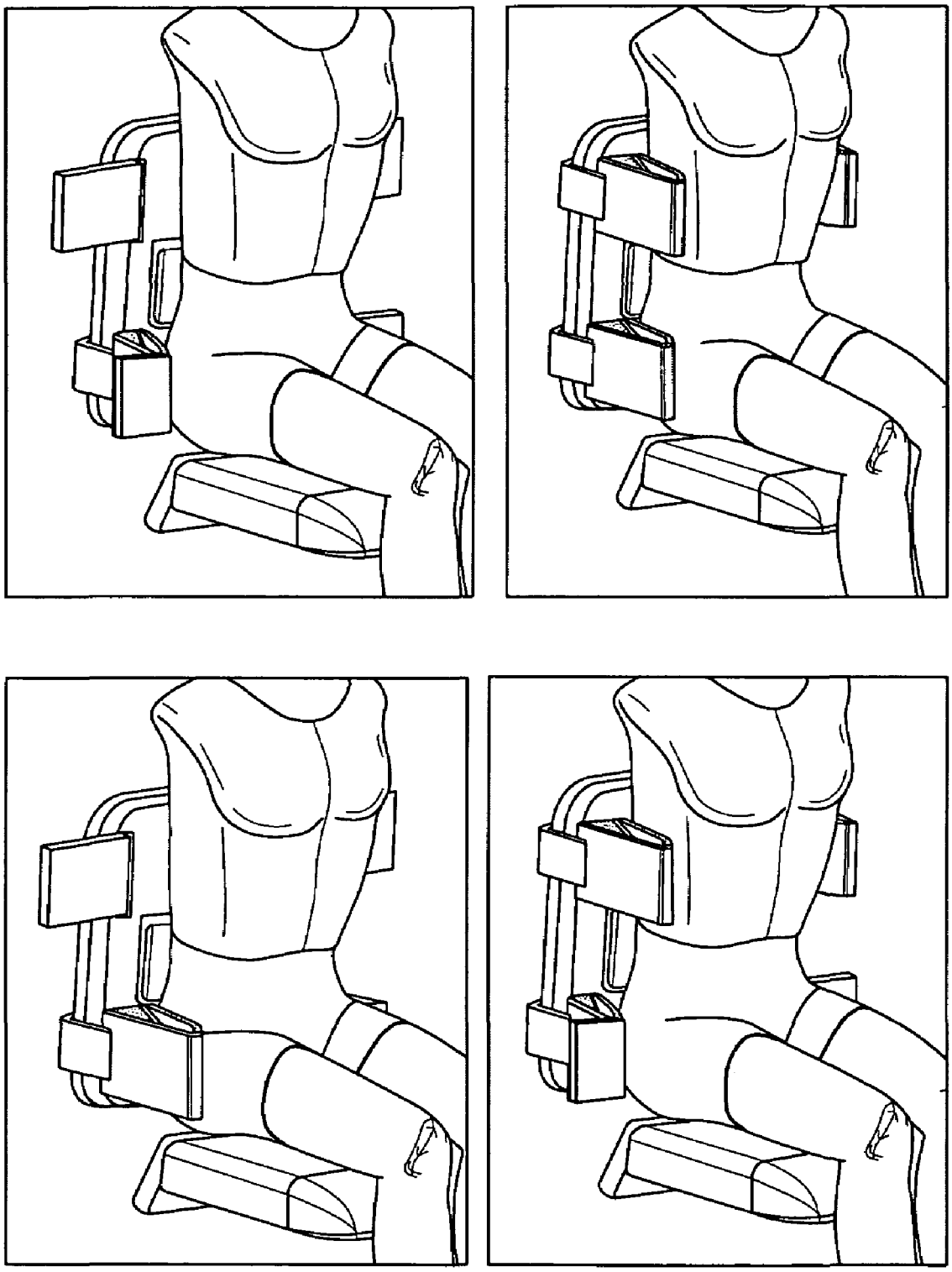

This various embodiments of the suspension system described herein can be used on different types of wheelchair seating configurations, two of which are illustrated in FIGS. 5 and 6.

Figure 7:
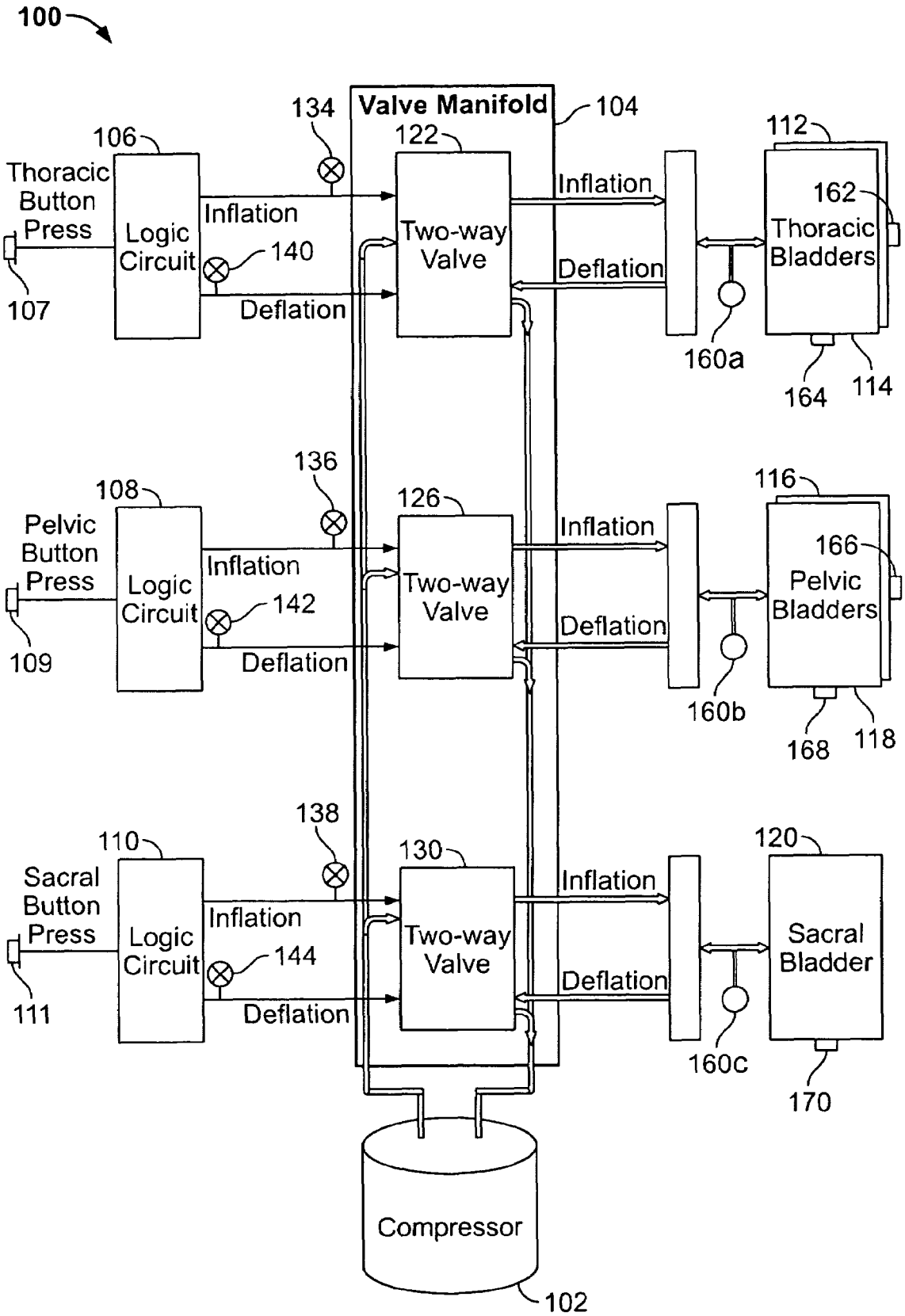
FIG. 7 shows an electro-pneumatic control system that may be used in an embodiment of the invention.

Referring to FIG. 7, an electro-pneumatic control system that may be used in conjunction with an embodiment of the invention will now be described. The system, generally labeled 100, includes an air compressor 102, a valve manifold 104, a first logic circuit 106, a second logic circuit 108, a third logic circuit 110, first and second thoracic bladders 112 and 114, first and second pelvic bladders 116 and 118, and a lumbo-sacral bladder 120. The first and second thoracic bladders 112 and 114 are disposed within the respective first and second thoracic supports (from FIG. 1), the first and second pelvic bladders 116 and 118 are disposed within the respective first and second pelvic supports 20 and 22, and the lumbo-sacral bladder 120 is disposed within the lumbo-sacral support 24. The system 100 further includes a first, a second, and a third inflation lamp 134, 136, and 138, as well as a first, a second, and a third deflation lamp 140, 142, and 144. The system 100 also includes a thoracic user control 107 electrically connected to the first logic circuit 106, a pelvic user control 109 electrically connected to the second logic circuit 108, and a lumbo-sacral user control 111 connected to the third logic circuit 110. Each of the user controls 107, 109, and 111 may be implemented in a variety of ways, including as a switch and as a button.

Referring still to FIG. 7, the valve manifold 104 includes a two-way valve 122 for the thoracic bladders 112 and 114, a two-way valve 126 for the pelvic bladders 116 and 118, and a two-way valve 130 for the lumbo-sacral bladder 120. The first inflation lamp 134 is electrically connected to the first logic circuit 106 and the two-way valve 122 for the thoracic bladders. The second inflation lamp 136 is electrically connected to the second logic circuit 106 and to the two-way valve 126 for the pelvic bladders. The third inflation lamp 138 is electrically connected to the third logic circuit 110 and to the two-way valve 130 for the lumbo-sacral bladder. The first deflation lamp 140 is electrically connected to the first logic circuit 106 and to the two-way valve 122 for the thoracic bladders. The second deflation lamp 142 is electrically connected to the second logic circuit 108 and to the two-way valve 126 for the pelvic bladders. The third deflation lamp 144 is electrically connected to the third logic circuit 110 and to the two-way valve 130 for the lumbo-sacral bladder 120.

Referring still to FIG. 7, the compressor 102 is pneumatically linked to each of the two-way valves 122, 126, and 130 of the valve manifold 104. The compressor 102 provides positive air pressure to the valves for inflating the bladders, and acts as an air pressure sink for the valves for the deflating the bladders. The valve 122 for the thoracic bladders is pneumatically linked to the thoracic bladders, such that when it is opened in a first position, air from the compressor 102 is forced into the first and second thoracic bladders 112 and 114, and when it is opened in a second position, air from the first and second thoracic bladders 112 and 114 is permitted to escape.

Similarly, the valve 126 of the pelvic bladders is pneumatically linked to the pelvic bladders, such that when it is opened in a first position, air from the compressor 102 is forced into the first and second pelvic bladders 116 and 118, and when it is opened in a second position, air from the first and second pelvic bladders 116 and 118 is permitted to escape.

Finally, the valve 130 of the lumbo-sacral bladder is pneumatically linked to the lumbo-sacral bladder 120, such that when it is opened in a first position, air from the compressor 102 is forced into the lumbo-sacral bladder 120, and when it is opened in a second position, air from the lumbo-sacral bladder 120 is permitted to escape.

Figure 8:
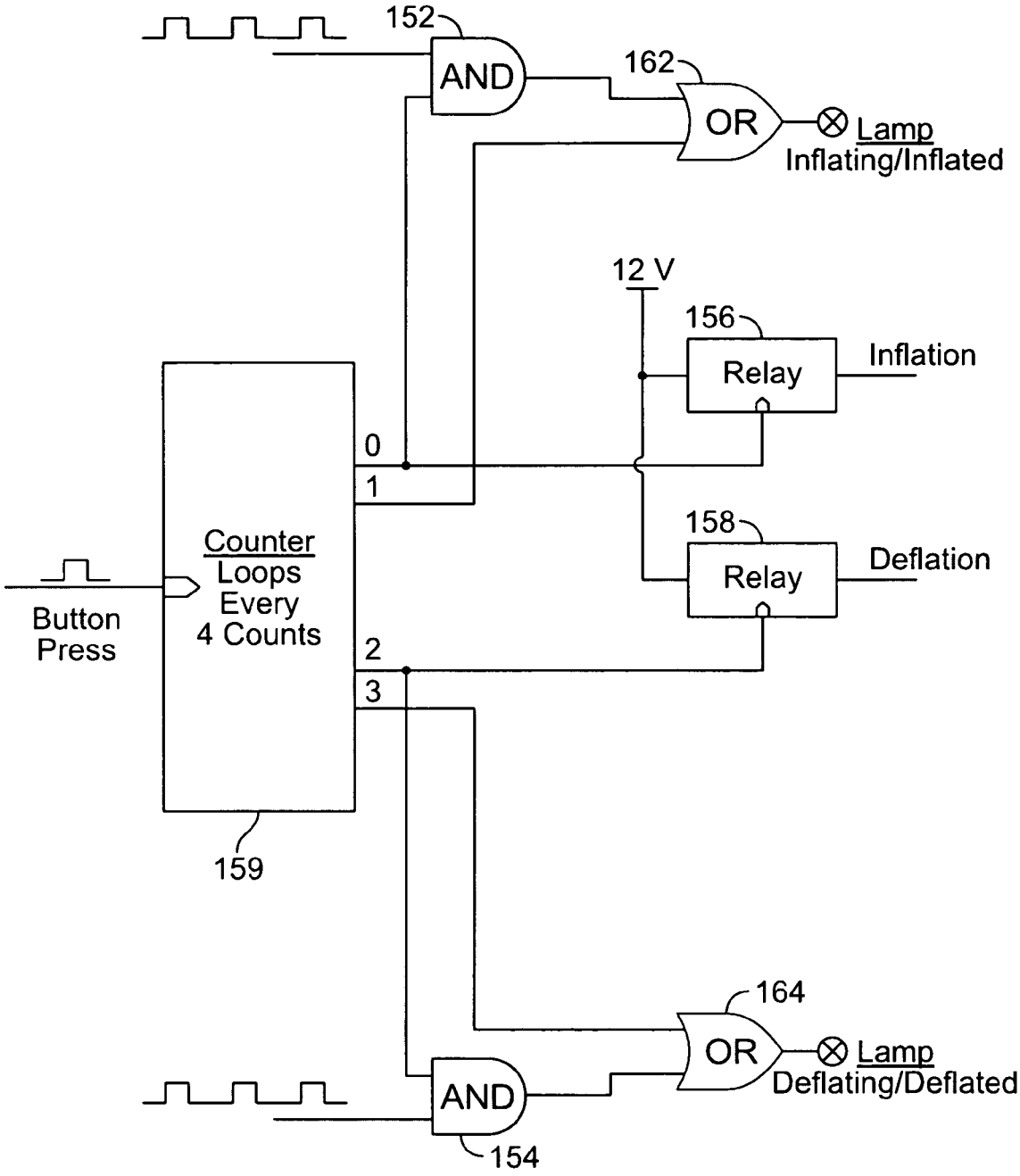
FIG. 8 shows logic circuitry that may be used in an embodiment of the invention.

Referring FIG. 8, an embodiment of one of the logic circuits 106, 108, and 110 will now be described in more detail. In this embodiment, the logic circuit includes a counter 159, a first AND gate 152, a second AND gate 154, a first OR gate 162, a second OR gate 164, a first relay 156, and a second relay 158, which are electrically connected to one another as shown. To operate the logic circuit, the user presses a button, which generates a single input signal. The counter 159 distributes the button-press signal to four channels. Channel 0 is connected to the first relay 156, which allows a 12 V signal to pass through to one of the valves to move the valve to its first position (to inflate its bladder), and to the first AND gate 152. Channel 1 and the output of the first AND gate 152 are connected to the first OR gate 162 which, in turn, is connected to the inflation lamp. Channel 2 is connected to the second relay 158, which allows the 12 V signal to pass to one of the valves to move the valve to its second position (to deflate its bladder), and to the second AND gate. Channel 3 and the output of the second AND gate 154 are connected to the second OR gate 164 which, in turn, is connected to the deflation lamp. The logic circuit is configured such that the inflation/deflation signals are only generated when the button is pressed by the user. The inflation/deflation signals will not be enabled when the button is released.

In one embodiment of the invention, the support system includes a pressure sensor system. The pressure sensor system prevents over inflation of the air bladders and prevents excessive contact between the supporting units and the user's body. Referring to FIG. 7, the pressure sensor system includes one or more pressure sensors connected to the air compressor airway proximate to each bladder that provide pressure reading of each air bladder, thereby ensuring accurate, continuous bladder pressure monitoring. One such sensor for each bladder or pair of bladders is shown with reference numbers 160*a*, 160*b*, and 160*c* in FIG. 7. The pressure sensor system also includes at least one contact sensor on each of the supporting units. As shown in FIG. 7, there are contact sensors 162 and 164 for the thoracic support units, contact sensors 166 and 168 for the pelvic support units, and a contact sensor 170 for the lumbo-sacral support unit. Although the contact sensors 162, 164, 166, 168, and 170 are shown as being directly attached to the bladders in FIG. 7, it is to be understood that these sensors may be attached to the outside casing of the support units in which the bladders are located. In one embodiment, one Force Sensitive Resistor (FSR) pressure sensor with a size of 1½"×1 ½" is attached to the user side of each supporting unit. If any of these sensors has a reading over the pre-set threshold for a given amount of time, an alarming signal will be activated both audibly and visually. The delay alarming time can be pre-set and adjusted.

It can thus be seen that a new and useful pneumatic support system for a wheelchair has been described. It should be noted that the use of articles such as "a" and "an" and "the" in the context of describing the invention (especially in the context of the following claims) are to be construed to cover both the singular and the plural, unless otherwise indicated herein. All methods described herein can be performed in any suitable order unless otherwise indicated. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. It should be understood that the illustrated embodiments are examples only, and should not be taken as limiting the scope of the invention.

What is claimed is:

1. A system for supporting a wheelchair user comprising:

a wheelchair including a seat, an upstanding backrest, and upstanding backposts for supporting the backrest;

mounting tracks affixed to the wheelchair generally parallel to the lateral edges of the backrest, the tracks being attached to the backposts for sliding movement on the backposts within a range constrained by limiting members and shock absorbing springs; and bilateral postero-lateral pelvic support units each movably attached to the mounting tracks by a lockable mechanism for adjusting and fixing the distance of the bilateral postero-lateral pelvic support units from the seat to establish a stable midline orientation of the user's pelvis, the bilateral postero-lateral pelvic support units including air bladders and associated control units accessible to and operable by the user and the support provided to the user by these units being adjustable by the user through operating the control units to inflate and deflate the air bladders;

the postero-lateral pelvic support units being mounted for superior/inferior, medial/lateral, and tilting adjustment to accommodate the user's body habitus and required degree of stability and mobility.

2. The system of claim 1 including a lumbo-sacral support unit adjustably attached to the backrest to allow positioning of the lumbo-sacral support unit for proper user pelvic tilt in the anterior posterior plane.

3. The system of claim 1 including in addition to or in lieu of the bilateral postero-lateral pelvic support units:

bilateral thoracic support units each movably attached to the mounting tracks by a locking mechanism for adjusting and fixing the distance of the bilateral lateral thoracic support units from the seat to maximize the user's trunk stability without compromising the user's performance of upper extremity functional tasks, the bilateral lateral thoracic support units being mounted for superior/inferior, medial/lateral, and tilting adjustment to accommodate the user's body habitus and required degree of stability and mobility.

4. The system of claim 3 in which at least some of the postero-lateral pelvic support units and the lateral thoracic support units are attached by way of a universal joint to permit tilting movement of the units and means are provided to lock the universal joints into the desired positions.

5. The system of claim 4 in which the tilting range of the universal joints is 41 to 50 degrees.

6. The system of claim 3 in which at least some of the postero-lateral pelvic support units and the lateral thoracic support units have a contoured shape that fits the user's body habitus.

7. The system of claim 3 in which the thoracic support units include air bladders and associated control units accessible to and operable by the user and the support provided to the user by these units may be adjusted by the user through operating the control units to inflate and deflate the air bladders.

8. The system of claim 1 in which the postero-lateral pelvic support units and the lateral thoracic support units include air bladders and associated control units operable from a user accessible location and the support provided to the user by these units may be adjusted by the user through operating the control units to inflate and deflate the air bladders.

9. The system of claim 1 in which at least one of the postero-lateral pelvic support units comprises a pre-shaped case contoured to fit the user's body habitus and oriented to contact the user's body, the case containing a foam cushion, an inflatable air bladder, and a backing board contained within the case and abutting a side of the air bladder.

10. The system of claim 9 in which the bladder has a dimension larger than the backing board and cushion.

11. The system of claim 9 in which the bladder surface facing the user is covered with a foam layer.

12. The system of claim 1 in which at least one of the bilateral lateral thoracic support units includes a case containing an inflatable air bladder and a bladder backing board comprising a plurality of vertically aligned boards.

13. The system of claim 1 including a vertically acting suspension interconnecting the backrest and the wheelchair to permit movement of the backrest relative to the seat as the wheelchair moves over uneven or rugged terrain to reduce the user's whole body vibration.

14. The system of claim 1 including:

at least one pneumatic pathway;

an air compressor connected to an air bladder via the pneumatic pathway;

a valve disposed along the pneumatic pathway, the valve having at least a first position, in which it permits pressurized air to travel from the compressor to the air bladder to inflate the air bladder, and a second position in which it permits air to escape from the air bladder to deflate the air bladder;

a control unit that, in response to a first input by the user, sends a first signal to the valve to move it to the first position to inflate the bladder and, in response to a second input by the user, sends a second signal to the valve to move it to the second position to deflate the bladder; and body contact sensors associated with the bladders to limit inflation of the air bladder to prevent excessive pressure between the supporting units and the user's body.

15. The system of claim 14, wherein the control unit comprises a logic circuit and a means for receiving the first and second inputs, the logic circuit being configured such that when a user makes the first input to the receiving means, the logic circuit generates an inflation signal, and when the user makes the second input to the receiving means, the logic circuit generates a deflation signal.

16. The system of claim 1 in which the postero-lateral pelvic support units are mounted for pivoting movement inwardly toward the user and outwardly away from the user so that these units can be pivoted toward a user once the user is seated in the wheelchair.

17. A system for supporting a wheelchair user comprising:

a wheelchair including a seat, an upstanding backrest having lateral edges, and upstanding backposts for supporting the backrest;

mounting tracks affixed to the wheelchair generally parallel to the lateral edges of the backrest, the tracks being attached to the backposts for sliding movement on the backposts within a range constrained by limiting members and shock absorbing springs;

bilateral postero-lateral pelvic support units each movably attached to the mounting tracks by a lockable mechanism for adjusting and fixing the distance of the bilateral postero-lateral pelvic support units from the seat to establish a stable midline orientation of the user's pelvis;

a lumbo-sacral support unit removably and adjustably attached to the backrest to allow positioning of the lumbo-sacral support unit for proper user pelvic tilt in the anterior posterior plane;

bilateral lateral thoracic support units each movably attached to the mounting tracks by a lockable mechanism for adjusting and fixing the distance of the bilateral lateral thoracic support units from the seat to maximize the user's trunk stability without comprising upper extremity functional tasks; and at least some of the postero-lateral pelvic support units and the lateral thoracic support units include air bladders and associated control units accessible to and operable by the user and the support provided to the user by these units may be adjusted by the user through operating the control units to inflate and deflate the air bladders.

18. The system of claim 17 including a shock absorbing suspension enabling vertical movement of the backrest relative to the seat as the wheelchair moves over uneven or rugged terrain to reduce the user's whole body vibration.

19. The system of claim 17 in which the postero-lateral pelvic support units and the bilateral lateral thoracic support units are mounted for pivoting movement inwardly toward the user and outwardly away from the user.

20. The system of claim 17 in which the postero-lateral pelvic support units and the bilateral lateral thoracic support units have a contoured shape that fits the user's body habitus.

21. The system of claim 17 in which the postero-lateral pelvic support units and the bilateral lateral thoracic support units are mounted for superior/inferior, medial/lateral, and tilting adjustment to accommodate the user's body habitus and required degree of stability and mobility.

22. The system of claim 17 in which the lateral thoracic support units and the bilateral lateral thoracic support units include a pre-shaped case contoured to fit the body habitus and a backing board abutting a side of the air bladder contained within the case.

23. A method for supporting a user in a wheelchair in a way that allows user adjustment independently of a caregiver comprising:

providing a wheelchair with mounting tracks affixed to the wheelchair generally parallel to the lateral edges of the backrest, the tracks being attached to the backposts for sliding movement on the backposts within a range constrained by limiting members and shock absorbing springs, and bilateral postero-lateral pelvic support units, bilateral lateral thoracic support units attached to the mounting tracks, and a lumbo-sacral support unit, the support units including air bladders and the support provided to the user by the units is adjusted by inflating and deflating the air bladders;

seating the user in the wheelchair with or without assistance from a caregiver;

adjusting and fixing the distance of the bilateral postero-lateral pelvic support units from the seat of the wheelchair to establish a stable mid-line orientation of the user's pelvis with the assistance of a caregiver;

adjusting and fixing the distance of the bilateral lateral thoracic support units from the seat to maximize the user's trunk stability without compromising the user's performance of upper extremity functional tasks;

positioning the lumbo-sacral support unit for proper user pelvic tilt in the anterior posterior plane with the assistance of a caregiver; and the support units including air bladders and the user inflating and deflating the air bladders to adjust the support units as needed without the assistance of a caregiver.

24. The method of claim 23 in which the postero-lateral pelvic support units and the lateral thoracic support units are mounted for pivoting movement inwardly toward the user and outwardly away from the user and these units are pivoted toward the user once the user is seated in the wheelchair.

25. The method of claim 23 in which the sensors activate an alarming signal when the sensors detect a contact pressure over a pre-set threshold.

* * * * *